US006101752A

United States Patent [19]

Cumberland

[11] Patent Number: 6,101,752

[45] Date of Patent: Aug. 15, 2000

[54] PHOTOGRAPH MOUNTING ASSEMBLY

[76] Inventor: Holly S. Cumberland, 3550 Cross Creek La., Malibu, Calif. 90265

[21] Appl. No.: 09/200,498

[22] Filed: Nov. 25, 1998

[51] Int. Cl.[7] ..... A47G 1/06

[52] U.S. Cl. ..... 40/778; 40/777; 40/773

[58] Field of Search ..... 40/778, 777, 768, 40/773, 702, FOR 159.1, 661.09, 594

[56] References Cited

U.S. PATENT DOCUMENTS

| | | | |
|---|---|---|---|
| 1,342,248 | 6/1920 | Bloomquist . | |
| 2,068,909 | 1/1937 | Engel | 40/778 |
| 2,093,598 | 9/1937 | Clark | 40/661.09 |
| 2,517,535 | 8/1950 | Cross | 40/778 |
| 2,622,055 | 12/1952 | Lieder | 40/778 X |
| 3,125,460 | 3/1964 | Rose | 40/778 X |
| 3,256,979 | 6/1966 | Tschentschel | 40/778 X |
| 3,624,688 | 11/1971 | Miller . | |
| 3,766,676 | 10/1973 | Slemmons . | |
| 4,016,664 | 4/1977 | Kaufmann . | |
| 4,275,520 | 6/1981 | Appleton et al. | 40/773 X |
| 4,301,199 | 11/1981 | Pfanstiehl . | |
| 4,479,318 | 10/1984 | Russell | 40/778 X |
| 4,991,330 | 2/1991 | Heidari . | |
| 5,226,996 | 7/1993 | Schober | 40/777 X |
| 5,328,729 | 7/1994 | Lamonte, Jr. | 428/14 |
| 5,433,023 | 7/1995 | Edwards et al. | 40/778 |
| 5,569,503 | 10/1996 | Piotroski . | |
| 5,799,429 | 9/1998 | Speshyock | 40/778 |
| 5,893,229 | 4/1999 | Werner | 40/773 |

FOREIGN PATENT DOCUMENTS

| | | | |
|---|---|---|---|
| 960080 | 4/1950 | France | 40/159.1 |

*Primary Examiner*—Anthony Knight
*Assistant Examiner*—Mark Williams
*Attorney, Agent, or Firm*—Stephen B. Salai, Esq.; Brian B. Shaw, Esq.; Harter, Secrest & Emery LLP

[57] ABSTRACT

A photograph retaining assembly is disclosed, wherein a backing substrate has an adhesive layer on one side and a plurality of retaining pockets on a second side. The retaining pockets formed to preclude perforation of the backing substrate.

16 Claims, 2 Drawing Sheets

PHOTOGRAPH MOUNTING ASSEMBLY

FIELD OF THE INVENTION

The present invention relates to an assembly for releasably mounting images, and more particularly to the releasable retention of a photograph to a page, wherein the photograph and a mount are simultaneously aligned with each and may be adhered to the page as a single element.

BACKGROUND OF THE INVENTION

The storage and display of images, such as photographs often significantly contributes to their value. That is, if a picture is never displayed, its value will likely not be realized. Even if the picture is displayed, the mounting of the picture may contribute to its degradation. That is, many current mounting components tend to deteriorate over time, thereby creating the risk of releasing the photograph from the mount. In addition, some mounts may actually degrade the retained photograph. This deterioration of the photograph may result from contact or exposure of the mount to the photograph. Chemicals from the mount may leech into the photograph and distort the image quality.

A further problem exists in mounting a picture to a given page in a desired location. Thus, misalignment often occurs. Devices employed for mounting pictures have utilized double-sided adhesive stickers which were stuck to the back of picture at the corners and then stuck to a mounting sheet by moistening the stickers. However, these adhesives are generally harmful to the photograph or prohibitively expensive.

Alternatively, slits in a mounting sheet have been used to retain a photograph with respect to the sheet. The slits are cut in the sheet and allow no user modification. Thus, there is no ability to locate the photograph in a particular location on a page.

Therefore, the need exists for a retention system that can retain a photograph without exposing the photograph to damaging adhesives. The need also exists for a system in which photographs are operably aligned with a mount or retainer, and the combination can be readily aligned with a page. A further need exists for a system that can be readily located with respect to a page such that a resulting location of the photograph is visible during the mounting process.

SUMMARY OF THE INVENTION

The present invention provides a mounting system that allows a photograph to be operably retained with respect to the mount and the combined photograph and mount to be located with respect to a support. The invention is particularly directed to mounting planar images such as photographs with respect to a support such as a page in an album.

The present invention includes a backing substrate having an adhesive on one planar surface that retains the backing substrate with respect to the support and a second planar surface of the backing substrate having a plurality of overlay areas, configured as retaining pockets, to retain a portion of a periphery of the photograph.

The present invention provides a mount for photographs, wherein no plastic layer is disposed over the face of the photograph to retain the photograph. Only a portion of the periphery of the photograph is covered in the present invention. Further, the portion of the periphery may be a corner or an edge of the photograph.

The present invention offers the benefit of simultaneously locating the photograph and associated mount to a page of a photo album. Specifically, the present invention obviates the need to locate and temporarily retain multiple individual corner supports to an album page. By providing a system having all the retaining pockets affixed to a substrate, the photograph and the substrate will not be subject to unintended separation, and accurate alignment with the album page is readily achieved.

DETAILED DESCRIPTION OF THE PREFERRED EMBODIMENT

Figure 1:
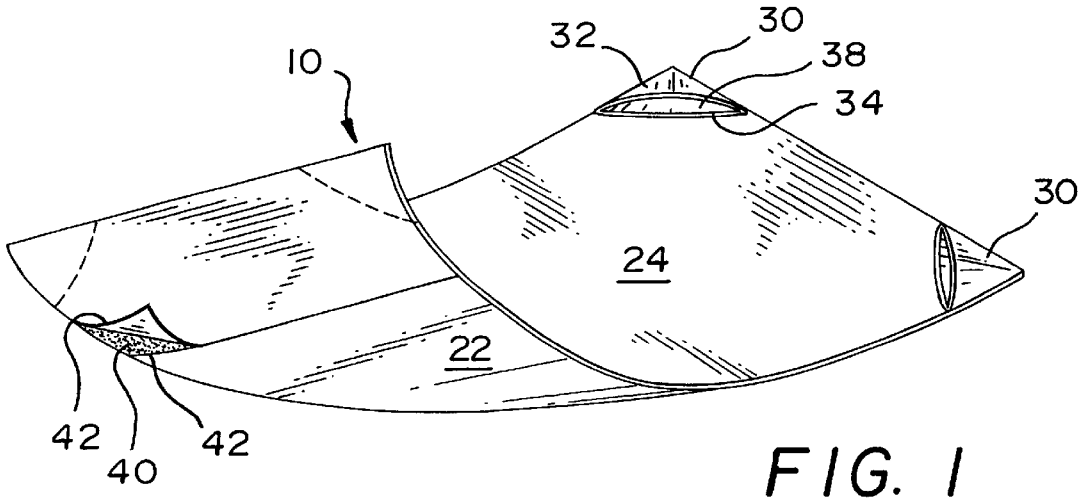
FIG. 1 is a perspective view of a first embodiment of the present invention.
Figure 5:
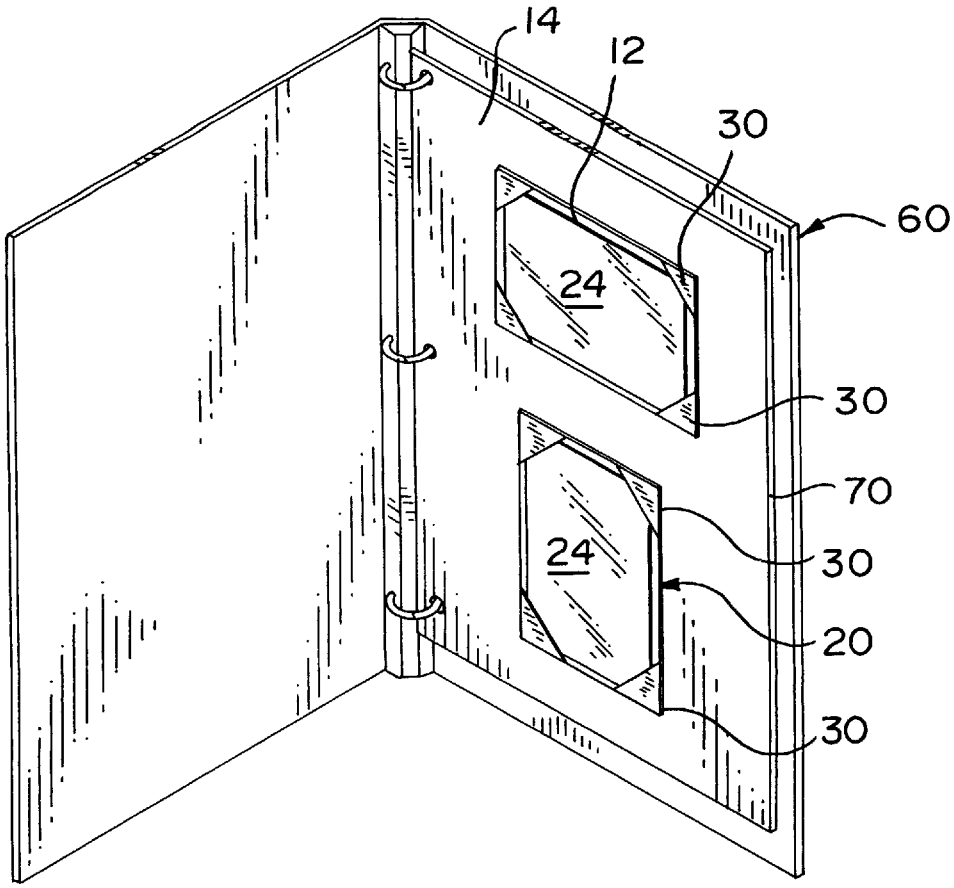
FIG. 5 depicts a support bearing two mounted backing substrates.

As shown in FIGS. 1 and 5, the present invention provides a mounting system 10 for locating a planar image 12 with respect to a support 14. The planar image 12 may be a print, a painting a photograph, drawing or other image. For purposes of the present description, the planar image 12 is set forth as a photograph. The support 14 may be a wall, a table top, or any surface with which the planar image 12 is to be displayed. For purposes of the present description, the support 14 is a page in a photo album.

Generally, the present invention includes a backing substrate 20 and a plurality of retaining pockets 30.

FIG. 1 shows a first embodiment of the invention including the backing substrate 20. Preferably, the backing substrate 20 has a first and a second planar surface 22, 24. The first planar surface 22 includes the adhesive material 40 and the second planar surface 24 contacts a rear surface of the photograph. The adhesive material 40 may be any variety of materials such as permanent or releasable adhesives. Preferably, the backing substrate 20 is non-degrading with respect to the planar image 12. A backing substrate 20 sold under the trademark CHARTPAK by Chartpak of Massachusetts has been found to be an acceptable material. The backing substrate 20 is impervious to the adhesive material 40 so that migration of the adhesive material from the first surface 22 to the second surface 24 is substantially precluded. Preferably, the adhesive layer 40 is initially covered by a releasable film 42 that is readily removed to expose the adhesive layer.

Figure 2:
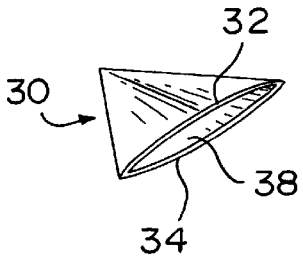
FIG. 2 is a perspective view of a retaining pocket in the first embodiment.

The second surface 24 of the backing substrate 20 includes the retaining pockets 30. The retaining pockets 30 are formed by an overlying member 32 that overlies a portion of the backing substrate 20. The overlying member 22 may be a portion of the backing substrate that has been folded to overlie the second surface 24. Alternatively, the overlying member 22 may be a separately formed member that is attached to the second surface 24 of the backing substrate 20. In a further configuration, the retaining pocket 30 may have a bottom 34 and the overlying member 22 joined along three sides, or so as to define a pocket having an opening 38. An outside of the bottom 34 will be joined to the second surface 24 of the backing substrate 20. The retaining pocket 30 may be joined to the backing substrate 20 by any of a variety of mechanisms such as adhesives, welding heat treating or other fixedly attaching process. The retaining pockets 30 have the opening 38 into which a portion of the planar image 12 is received. The retaining pockets 30, shown in FIG. 1 and FIG. 2, are constructed to encompass a corner of the planar image 12 to be retained. The retaining pockets 30 are preferably formed of an archival material that will not degrade the planar image 12.

The retaining pockets 30 may separately formed from the backing substrate 20 and affixed to the substrate at any location. Thus, a user may identify the desired location of the planar image 12 with respect to the backing substrate 20 and affix the retaining pockets 30 at the required locations to the second surface 24. The planar image 12 is then engaged by the retaining pockets 30 and the backing substrate 20 and engaged planar image 12 are bonded to the page.

Preferably, the retaining pocket 30 is sufficiently affixed to the backing substrate 20 so that non destructive separation is substantially precluded.

Figure 3:
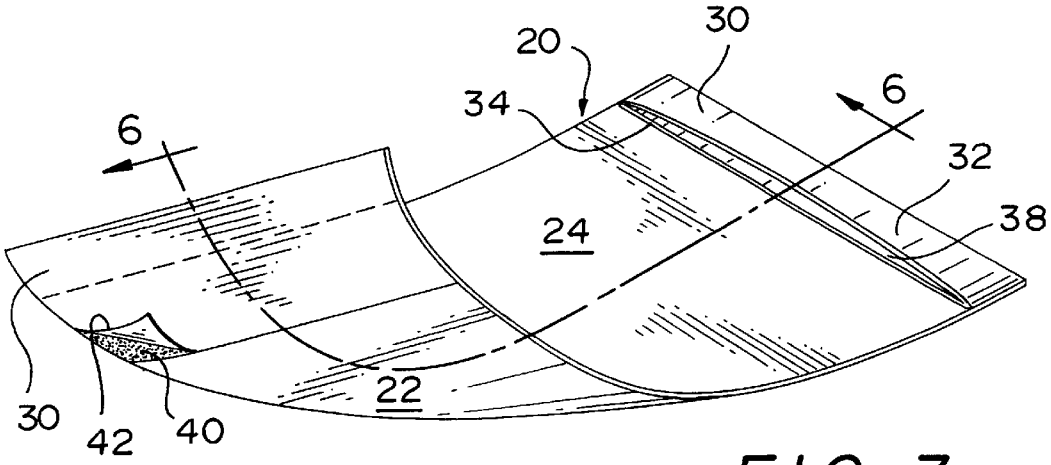
FIG. 3 is a perspective view of a second embodiment of the invention.
Figure 4:
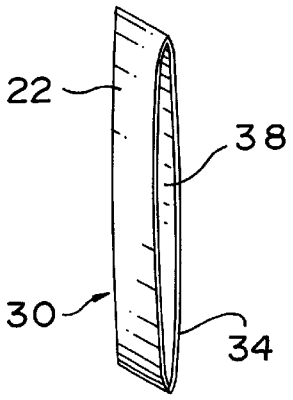
FIG. 4 is a perspective view of an expanded retaining pocket for receiving a portion of the periphery of a planar image.

The retaining pockets 30 may have any of a variety of configurations. The retaining pockets 30 may engage a corner of the planar image 12, or an edge of the planar image 12. FIG. 3 shows a second embodiment in which retaining pockets 30 extend along an entire dimension of the planar image 12 along a periphery. FIG. 4 shows the opening 38 which permits retention of a planar image 12.

FIG. 5 shows a configuration of the invention in which a planar image 12 is retained by the retaining pockets 30 with respect to the backing substrate 20. A page 70 of a photo album 60 holds two of the mounting assemblies.

Figure 6:
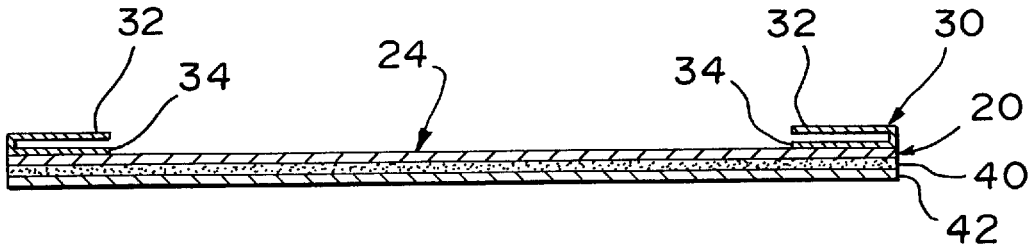
FIG. 6 is an exaggerated cross sectional view taken along lines 6—6 of FIG. 3.

FIG. 6 shows a cross sectional view taken along line 6—6 of FIG. 3 in which the retaining pocket 30 includes the overlying member 22 and the bottom 34 adhered to the second surface 24 of the backing substrate 20. The backing substrate 20, in turn, has the adhesive layer 40 with the releasable film 42.

Thus, the planar image 12 may be displayed without the use of a plastic overlay. Any damage that may result from extended contact between the planar image 12 and a plastic overlay is reduced. In addition, the planar image 12 is readily visible without the distorting effects of a plastic overlay. It is contemplated the backing substrate 20 may be sized and include sufficient retaining pockets 30 to locate two or more planar images 12. Further, the backing substrate 20 may be sized to accommodate any of a variety of photograph sizes.

The present invention offers the benefit of locating the planar image 12 and associated mounting system 10 to a page in the photo album. In prior systems, a user had to balance a corner mount on all four corners of the photograph and then align the photograph with the page, trying to place a balanced corner mounts and photo on the page. In these prior systems, a corner mount invariably fell off or the photograph was misaligned. By mounting the planar image 12 to the substrate 20 prior to aligning with the support, wherein the substrate and the photograph are not be subject to unintended separation, the present invention thus allows accurate alignment with the album page.

In use, the protective film 42 is removed, thereby exposing the adhesive 40. The adhesive 40 and substrate 20 is then affixed to the support 14, with or without the planar image 12. The second surface 24 of the backing substrate 20 has previously adhered retaining pockets 30 which are ready to receive a planar image 12. Simply by inserting an edge of the planar image 12 into the opening 38, the planar image is easily mounted relative to the backing substrate 20.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A mount for releasably retaining a planar image relative to a support, comprising:

(a) a backing substrate having a first and a second planar surface defined by a periphery;

(b) an adhesive layer on the first surface of the backing substrate;

(c) a removable film on the adhesive layer; and (d) a plurality of retaining pockets having a bottom wall and an overlying wall, each wall formed of a different material than the backing substrate, the bottom wall connected to the backing substrate to preclude non destructive separation.

2. The mount of claim 1, wherein the retaining pockets have a triangular periphery.

3. The mount of claim 1, wherein the retaining pockets have a rectangular periphery.

4. The mount of claim 1, further comprising an adhesive intermediate the bottom wall and the backing substrate, the adhesive located to preclude contact with the planar image upon operable engagement with the mount.

5. The mount of claim 1, wherein the retaining pockets are substantially transparent.

6. The mount of claim 1, wherein the retaining pockets are opaque.

7. A method of forming a retaining for releasably retaining a planar image with respect to a backing substrate, comprising:

(a) disposing an adhesive on a first planar surface of a contiguous backing substrate;

(b) releaseably covering the adhesive layer with a film; and (c) attaching a plurality of retaining pockets having a bottom wall and a top wall to the backing substrate, the retaining pockets overlying a portion of the backing substrate and formed of a different material than the backing substrate.

8. The method of claim 7, further comprising forming the retaining pockets of an opaque material.

9. The method of claim 8, wherein the corners and an edge of the planar image between the corners are disposed in a rectangularly shaped retaining pocket.

10. A mount assembly for releaseably retaining a planar image to preclude adhesive contact with the planar image, the mount assembly comprising:

(a) a backing substrate having a first and a second planar surface;

(b) an adhesive layer on the first surface of the backing substrate;

(c) a protective film releaseably engaged with the adhesive layer; and (d) a plurality of retaining pockets separately formed and of a different material from the backing substrate having a bottom and an overlying member to define a pocket opening, the bottom having an area at least as large as the overlying member and bonded to the backing substrate to preclude non destructive separation of the retaining pocket from the backing substrate;

the backing substrate and the retaining pockets selected to preclude adhesive contacting the planar image.

11. The assembly of claim 10, wherein the backing substrate has a periphery substantially coincident with a periphery of the planar image.

12. The assembly of claim 10, wherein the backing substrate precludes migration of the adhesive through the backing substrate.

13. The assembly of claim 10, further comprising an adhesive intermediate the retaining pockets and the second planar surface.

14. The assembly of claim 10, wherein the retaining pockets are substantially transparent.

15. The assembly of claim 10, wherein the retaining pockets are opaque.

16. A mount for releaseably retaining a planar image, comprising:

(a) a backing substrate having a first and a second planar surface;

(b) an adhesive layer covering the first surface of the backing substrate;

(c) a removable film on the adhesive layer; and (d) a plurality of retaining pockets connected to the backing substrate, each retaining pocket separately formed of an archival material different from the backing substrate and having a bottom wall and an overlying wall to form a pocket opening, the bottom wall non-releaseably connected to the backing substrate and precluding adhesive contact with the planar image, the bottom wall and the overlying wall having a substantially smaller area than the backing substrate.

* * * * *